United States Patent [19]

Kimpel et al.

[11] Patent Number: 4,491,813

[45] Date of Patent: Jan. 1, 1985

[54] ELECTROMAGNETIC RELAY

[75] Inventors: Rolf-Dieter Kimpel, Unterschweinbach; Horst Tamm, Munich; Wolfgang Hübner, Munich; Erwin Steiger, Munich, all of Fed. Rep. of Germany

[73] Assignee: Siemens Aktiengesellschaft, Berlin & Munich, Fed. Rep. of Germany

[21] Appl. No.: 401,236

[22] Filed: Jul. 23, 1982

[30] Foreign Application Priority Data

Aug. 14, 1981 [DE] Fed. Rep. of Germany ..... 3132239

[51] Int. Cl.[3] ..... H01H 50/58

[52] U.S. Cl. ..... 335/187; 335/179; 335/124; 335/81

[58] Field of Search ..... 200/246; 335/78, 79, 335/81, 124, 125, 128, 179, 187, 127, 129, 106, 185, 200

[56] References Cited

U.S. PATENT DOCUMENTS 2,727,114 12/1955 Kesselring ..... 200/246

3,548,131 12/1970 Piber ..... 200/283

4,360,794 11/1982 Schedele ..... 335/187

FOREIGN PATENT DOCUMENTS 2458418 7/1975 Fed. Rep. of Germany ..... 335/106

*Primary Examiner*—William M. Shoop

*Assistant Examiner*—Jeffrey Sterrett

*Attorney, Agent, or Firm*—Hill, Van Santen, Steadman & Simpson

[57] ABSTRACT

An electromagnetic relay has a bar-shaped armature which is mounted at one end at a coil flange in a carrier comprised of insulating material, in which center contact blades are also mounted at opposite sides of the armature such that movement of the armature is transmitted to the contact blades through the carrier, thus eliminating the plunger which is normally present for contact actuation. The offset positioning of the contact blades with respect to the armature in the carrier causes friction which substantially prevents damaging impact of the contact pads of the contact blades with respectively mating stationary contact pads.

20 Claims, 10 Drawing Figures

ELECTROMAGNETIC RELAY

BACKGROUND OF THE INVENTION

1. Field of the Invention

The present invention relates to electromagnetic relays, and in particular to electromagnetic relays having an elongated armature extending substantially parallel to the axis of the excitation coil and to which at least one contact element is connected at one side thereof via an insulating element so as to be substantially parallel to the armature and having a free end for making and breaking with at least one cooperating stationary contact element.

2. Related Application

This application is related to the application of R. -D. Kimpel, U. Rauterberg and H. Tamm filed simultaneously herewith entitled "Polarized Electromagnetic Relay" and assigned Ser. No. 401,235.

3. Description of the Prior Art

A relay is described in British Pat. No. 1,258,862 having a coil body with a plurality of center contact springs disposed in a plane which are clamped by means of a resilient retaining clamp to a plate-like armature. The contact springs are electrically insulated from the armature by an intervening insulating foil. The contact springs thus simultaneously form the bearing for the armature which, upon excitation of the relay, bridges two yoke core elements disposed at a distance from the armature. The flat side of the armature is disposed opposite the spring contacts. A separate actuation plunger is eliminated in this conventional structure by means of the direct connection of the contact springs with the armature. Because of the elimination of the conventional plunger, the friction caused by such a plunger which is injurious to the contacts is not present.

The above-described conventional structure has the disadvantage, however, that not only the armature and the core, but also all center contact springs are disposed inside the coil body, thereby requiring a coil with a relatively large diameter. As a result of the position of the armature and the permanently connected center contact springs with respect to the cooperating stationary contacts, a relatively short spring length is necessary thereby resulting in significant stressing of the material comprising the spring contact elements, thereby contributing to a shortened relay useful life. Moreover, the positioning of the movable contact springs directly at one side of the flat armature has the disadvantage that the armature can form a working air gap only at the one flat side thereof which is opposite the contact springs so that the relay is not suitable for use with a polarized magnetic system in which the armature forms working air gaps with two opposite pole plates for movement therebetween.

SUMMARY OF THE INVENTION

It is an object of the present invention to provide a relay having a bar-like armature mounted in a carrier in which movable contact blades are also mounted which achieves making and breaking of the contact pads of the contact blades with corresponding stationary contact pads such that good electrical contacting results with a relatively low stressing of the contact blade material.

It is another object of the present invention to provide such an electromagnetic relay wherein the armature can be switched freely in any desired magnetic system over its entire length, and in particular to provide such a relay in which efficient polarized magnet systems can be employed.

The above objects are inventively achieved in an electromagnetic relay having a bar-like armature secured at one end to an insulating carrier at a first coil flange and which extends over the entire coil length up to the opposite second coil flange where the armature forms a working air gap with at least one pole plate, and in which contact blades are also anchored in the carrier and also extend substantially over the entire coil length outside of the coil spaced from the armature.

The insulating carrier functions to hold the armature and the movable blade contacts at a distance from one another as well as to seat the armature and blades in common at one of the coil flanges. The armature and the movable blade contacts extend parallel to the coil axis to the opposite coil flange such that the magnet system and the contacting elements do not inhibit each other so as to insure proper spacing. The bearing location is at such a distance from the making and breaking contact locations such that substantially no abrasion is present at the contacting surfaces or pads of the contact blades. Additionally, the bearing friction is very slight because, as a result of the elongated structure of the armature and the parallel blade contacts, the armature stroke results in only a slight pivoting motion at the bearing. The armature itself may be disposed inside of the coil body along the coil axis, whereas the contact springs connected to the armature via the insulating carrier are outside of the coil body. As a result of this structure, a very sensitive polarized magnet system can be employed, and because only the armature is disposed within the coil body, and requires a very small volume, the coil can be made with a smaller diameter than is possible in conventional structures.

A further advantage of the structure disclosed and claimed herein results from the fact that the spring material comprising the movable contact blades mounted in the carrier is only slightly stressed during operation because of the long moment arm formed by the contact blades, so that relatively thick contact blades can be utilized. An optimum exploitation of the excitation energy is obtained in the relay disclosed and claimed herein because the energy introduced into the contact blades is fully converted into contact force without an intervening actuation plunger. The long contact blades are freely disposed next to the coil so that the blades are easily accessible for adjustment purposes, further insuring a high contact reliability. Contact-free adjustment and/or alignment methods can be utilized, such as the method employing dosed heat application described in German OS 29 18 100.

In one embodiment of the invention, the movable contact blades are secured in the carrier in an extension of the bearing axle of the armature. In this embodiment the contact blades are directly aligned with the armature and are moved by an amount corresponding exactly to the movement of the armature upon excitation of the relay. In a further embodiment, however, the movable contact blades are secured in the carrier parallel to the armature but offset relative to the bearing location so that the center of motion relative to the bearing location of the contact blades deviates from the position at which they are secured to the carrier, so that the contact blades execute a rubbing motion against the respective cooperating stationary contact elements during switching. As a result, the contact impacts and the corresponding reduced contact life resulting therefrom are significantly reduced.

At least one movable contact blade is preferably symmetrically disposed at opposite sides of the armature, however, in a further embodiment of the invention two movable contact blades may be mounted in registry in the carrier one above the other so that the insulating carrier may accommodate four or more contact blades.

The insulating carrier is preferably a T-shaped block in which the armature is secured in the central portion and one or more contact blades are secured in the opposed lateral arms. The contact blades may be secured in the carrier with a fastening end which proceeds straight into the carrier, which may be undertaken in a known manner either by means of forced insertion or by embedding, such as by injection molding. In a further embodiment of the invention, the contact blades may exhibit a bend such that the fastening end is disposed at right angles relative to the bearing axis and such that the portions of the contact blades carrying the contact pads proceed parallel to the armature.

In another embodiment of the invention the contact blades secured in the carrier may be divided into first and second sections. The first section of the contact blades is closer to the insulating carrier and has a thickness which is greater than the second section of the contact blades, which is farther from the insulating carrier and on which the contact pads are carried. The contact blades thus exhibit a stepped cross-section with the thinner second section exhibiting a high elasticity as a result of the small thickness, thus insuring reliable contacting with the respective cooperating stationary contact elements. In order to achieve double contacting, the thinner second section may have a longitudinal slot. The thicker first section of the contact blades insures a longer contact blade life and is well-suited for adjustment of the contact blades. In the aforementioned adjustment method utilizing dosed heat application, for example by means of laser beams, the contact blades may be adjusted without being heated over their entire thickness by the thermal radiation, and thus alteration of the spring characteristics of the contact blades is less likely to occur than is the case with uniformly thin contact blades. The first thicker section of the contact blade comprises at least half of the total free spring length of the contact blade, and is preferably approximately three times as thick as the second section.

The carrier is seated in recesses of the coil flange by means of a bearing neck integrally formed on the coil flange. In another embodiment of the invention the carrier may be provided with bearing blades which are seated in corresponding notches of the coil flange. In this embodiment, the carrier is urged by a spring into the bearing of the coil flange. The spring may consist of ferromagnetic or non-magnetic material and may be comprised of a synthetic strip or film. The armature may also be held in the bearing by means of a flux plate for the magnetic circuit whereby, under certain conditions, a spring or a resilient foil is disposed between the flux plate and the carrier.

In a further embodiment of the invention bearing necks formed onto the armature are latched into slotting bearing bushes of the coil body for retaining the armature. The bearing bushes have a diameter which corresponds at least to the diameter of the bearing necks. Only a slight bearing friction results from this structure and a slight play of the bearing necks in the bushings has an unnoticeable effect on the switching movements at the opposite free end of the armature and at the contacting ends of the contact blades.

DESCRIPTION OF THE PREFERRED EMBODIMENTS

Figure 1:
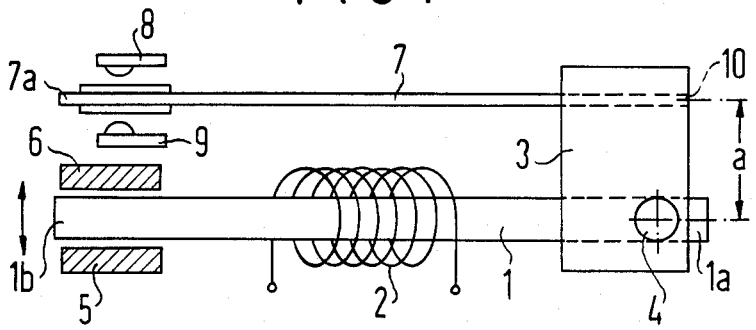
FIG. 1 is a simplified schematic illustration exhibiting the inventive concept for a relay disclosed and claimed herein.

A simplified schematic diagram showing the concept of operation of the relay disclosed and claimed herein is shown in FIG. 1. The relay includes a relay armature 1 which extends through a coil winding 2 along its axis and is mounted at one end 1*a* in a carrier 3 consisting of a block of insulating material and is seated therein by means of a peg 4. The armature executes switching movement between two pole plates 5 and 6 as indicated by the double arrow at its free end 1*b*. As used herein the term "pole plate" means that element with which the armature forms a working air gap. A "pole plateA38 will thus be present even in those embodiments not having a permanent magnet system.

At least one contact blade 7 is also mounted in the carrier 3 extending parallel to the coil 2 over its entire length. The contact blade 7 operates as a leaf spring and executes switching movements at a free end 7*a* between cooperating stationary contacts 8 and 9. As a result of the spacing a between the bearing axis at the peg 4 and the chucking location 10 of the contact blade 7, the free end 7*a* of the contact blade 7 moves in an arc of a circle having a center at the peg 4, which serves as the bearing neck, and thus the free end 7*a* executes a rubbing motion against the stationary contacts 8 and 9. As a result, contact impacts between the free end 7*a* and the stationary contacts 8 and 9 are largely suppressed. In accordance with the descriptions below, the carrier 3 may be symmetric relative to the bearing axis at the peg 4 and receive another contact blade spaced on the other side of the armature 1.

Figure 4:
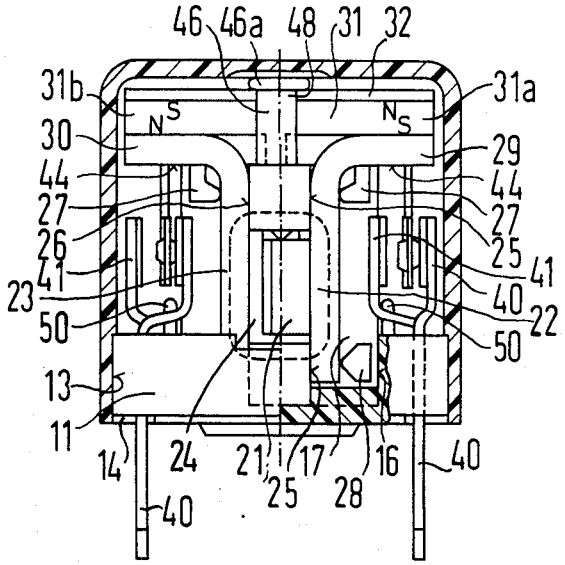
FIG. 4 is an end sectional view taken along line IV—IV of FIG. 2.
Figure 2:
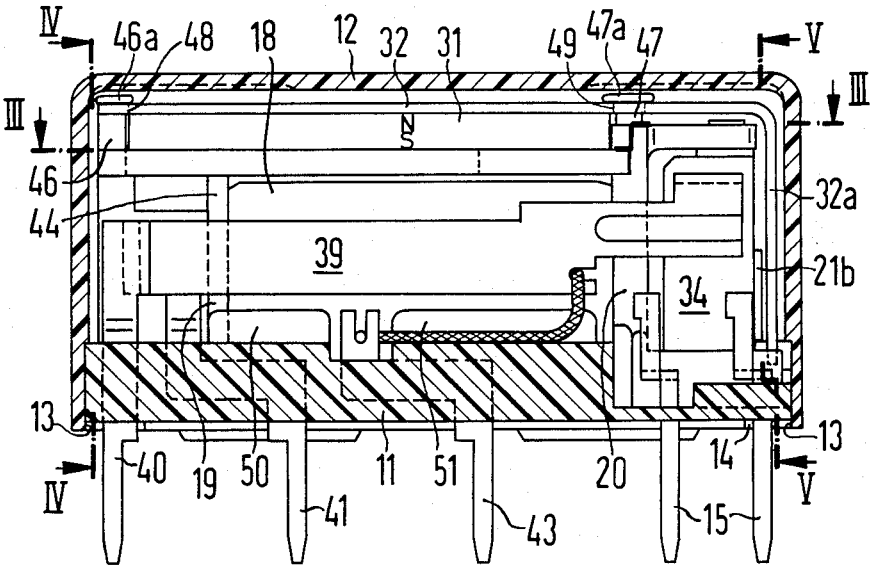
FIG. 2 is a side sectional view of a relay constructed in accordance with the principles of the present invention.

A relay constructed in accordance with the principles of the present invention is shown in various sectional views in FIGS. 2 through 6 and has a polarized (i.e. permanent) magnet system and two switching contacts, although other magnet systems (such as a non-polarized system) and contact fittings can also be accommodated without departing from the inventive concept disclosed and claimed herein. The relay is constructed on a base body 11 and is closed with an insulating protective cap 12. The edge seam 13 between the base body 11 and the cap 12 is sealed with suitable casting resin 14, as are the passages of the coil connection pins 15 through the base body 11. A coil body 17 with a coil winding 18 wound thereon is seated on the base body 11 in a precisely fitting recess 16, as best seen in FIG. 4, the winding 18 being limited at its end faces by two spaced coil flanges 19 and 20. A bar-shaped armature 21 extends through the inside of the coil body 17 along the axis of the coil 18 and is seated at the coil flange 20 at a fixed end **21*b* and executes switching movement between two pole plates 22 and 23 with its opposite free end 21*a***.

In order to fix the width of the working air gap 24 between the two pole plates 22 and 23, respective seating surfaces 25 and 26 are provided on the coil body 11, the pole plates 22 and 23 being respectively pressed against the seating surfaces 25 and 26 by means of noses 27 and 28 integrally formed on the coil flanges. The pole plates 22 and 23 are depending legs of respective yokes 29 and 30, which extend above the winding 18 parallel to the axis thereof and parallel to the base body 11. A flat elongated permanent magnet 31 with two oppositely polarized permanent magnet regions **31*a* and 31*b* is disposed against the yoke 29 and 30. The pole surfaces of this quadripole permanent magnet 31 opposite the yokes 29 and 30 are covered by a flux plate 32** which closes both the permanent flux circuit and the excitation flux circuit.

Figure 5:
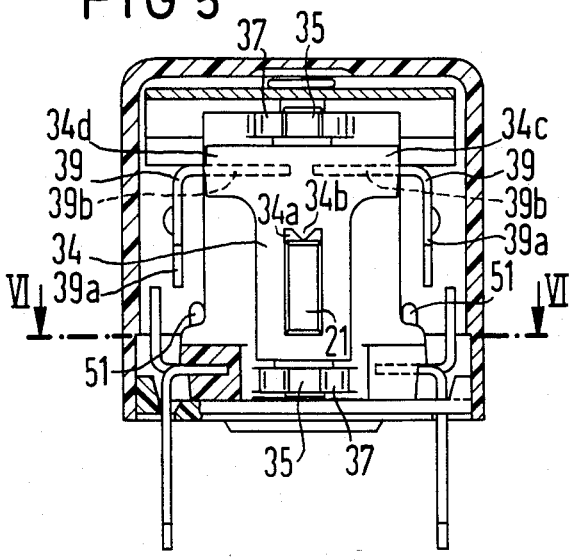
FIG. 5 is an opposite end sectional view taken along line V—V of FIG. 2.
Figure 6:
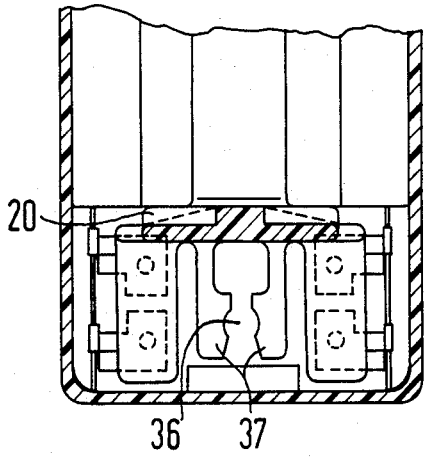
FIG. 6 is a partial plan sectional view of a relay constructed in accordance with the principles of the present invention taken along line VI—VI of FIG. 5.

The armature 21 is mounted in a carrier 34 consisting of a block of insulating material. For this purpose, the carrier 34 has a passage **34*a* into which the armature is secured, as best seen in FIG. 5. A rib 34*b* formed on a wall of the passage 34*a* compensates for the sectional tolerance in the armature 21 and insures a tight fit of the armature 21 with respect to the horizontal plane. The carrier 34 has bearing necks 35 integrally formed at respective upper and lower sides thereof, the bearing necks 35 being seated in bearing bushings 36. The bearing bushings 36 are respectively formed by two resilient retaining clamps 37 which are also integrally formed on the coil flange 20. This assembly is shown in FIG. 6 in a sectional view taken along line VI—VI of FIG. 5 before assembly of the armature. During assembly of the armature, the bearing necks 35 are snapped in between the two resilient clamps 37. In order to cause as little bearing friction as possible, the diameter of the bearing bushing 36 is selected at least as large as the diameter of the bearing neck 35. This permits the individual parts to be fabricated in such a manner that, as a result of this tolerance, a certain amount of play between the bearing neck 35 and the bearing bushing 36 exists at all times. This slight amount of play has virtually no effect on the switching operation of the armature due to the long length of the armature 21**.

The carrier 34 is a T-shaped block and has contact blades 39 mounted in its two lateral arms **34*c* and 34*d*, as best seen in FIG. 5. The contacts blades 39 form center contact springs for movement between two stationary contacts at an opposite end of the relay and are co-movable with the switching movement of the armature 21 as a result of the rigid mounting of the armature 21 and the contact blades 39 in the carrier 34. The need for a plunger as in conventional relays is thus eliminated. The free end 39*a* of each contact blade 39 makes and breaks electrical contact with cooperating stationary contact elements 40 and 41 which are provided in a standard manner with contact surfaces or pads. The center contact springs 39 are respectively connected to a terminal pin 43 via a connecting wire 42. The cooperating contact elements 40 and 41 are respectively fastened directly in the base body 11. The fixed ends 39*b* of the contact blades 39 are respectively embedded in the lateral arms 34*c* and 34*d* of the carrier 34 and emerge laterally from the carrier 34 opposite one another and are bent and angled such that their free ends 39*a* extend parallel to the armature 21**.

In assembly of the magnet system, the two yokes 29 and 30 are slipped into the coil body 17 in such a manner that the pole plates 22 and 23 are positioned between the seating surfaces 25 and 26 and the noses 27 and 28. The yokes 29 and 30 lie against respective shoulders 44 and 45 of the coil flanges 19 and 20. The yokes 29 and 30 together with the permanent magnet 31 and the flux plate 32 are fixed in position by means of two pegs 46 and 47 which are integrally formed on the thermoplastic coil body 17. The pegs 46 and 47 are inserted through respective recesses 48 and 49 of the flux plate 31 and are deformed over the flux plate 31 to form rivet heads **46*a* and 47*a***.

The above-described structure and manner of assembly permits the dimensions of the working air gap 24 formed by the pole plates 22 and 23 and the dimensions and spacing of the armature 21 at its two switching positions relative to the stationary contact elements 40 and 41 at both sides of the coil body 17 to be accurately fixed. Because the cooperating contacts 40 and 41 can be aligned very precisely relative to one another by virtue of being plugged into the base body 11, only the center contact blades 39 need still be adjusted during assembly, which can be easily accomplished as a result of their rigid connection to the armature 21, so that no additional tolerances as are normally present due to the use of a contact plunger or the like need be considered. The adjustment of the center contact blades 39 is a "path adjustment" and can be easily automated.

In order to well insulate the center contact blades 39 and their respective connecting wires 42 relative to the coil winding 18, additional insulating ribs 50 and 51 are disposed on the base body 11 at both sides of the coil 18.

Figure 7:
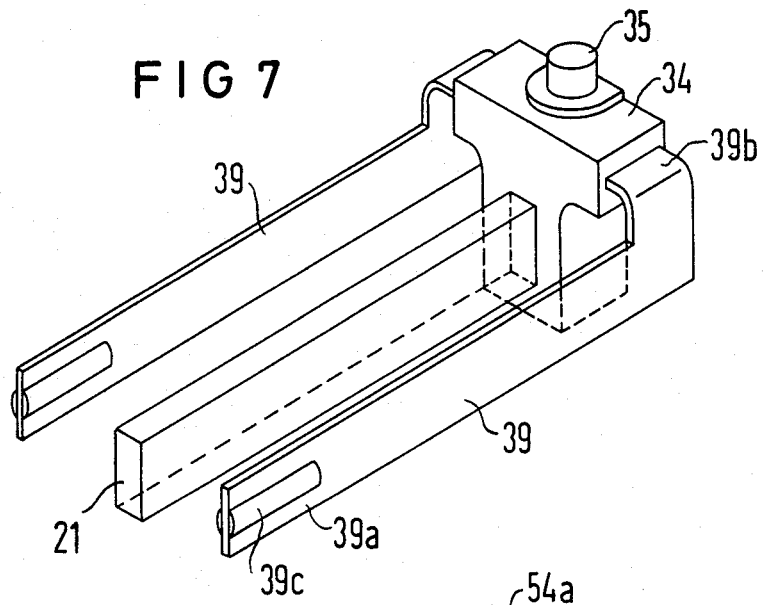
FIG. 7 is a perspective view of an armature and two contact blades mounted in a carrier in accordance with the principles of the present invention.

The carrier 34 with the armature 21 and the two center contact blades 39 inserted therein is shown in perspective view in FIG. 7 removed from the relay. As a result of the spacing of the center contact blades 39 relative to the armature bearing (the bearing neck 35) the contact pads **39*c* at the free ends 39*a* of the contact blades 39 execute a rubbing motion relative to the cooperating stationary contacts 40 and 41. In a further modification, which is not shown in FIG. 7, intermediate members may be embedded in the carrier 34 to which the contact springs 39 are riveted or welded outside of the carrier 34**.

Figure 8:
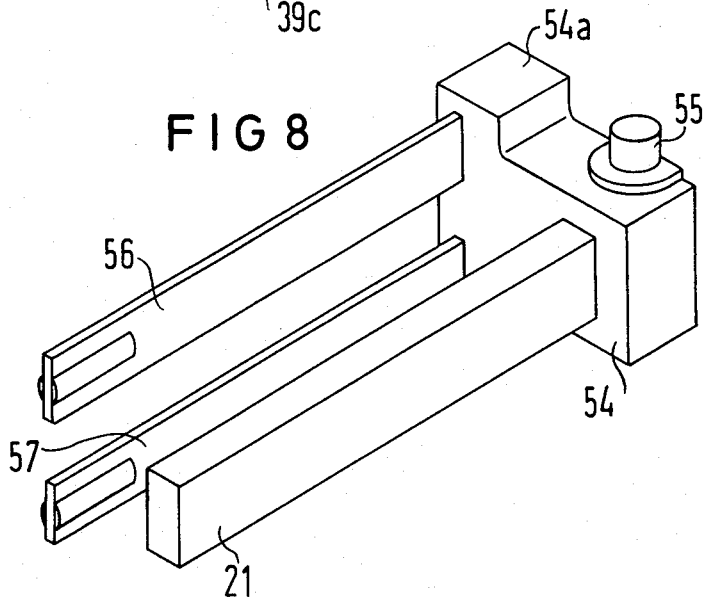
FIG. 8 is a second embodiment of an armature and two contact blades mounted in a carrier in accordance with the principles of the present invention.

A further embodiment of the carrier is shown in perspective view in FIG. 8. In this embodiment, the carrier 54 has the armature 21 mounted therein and the carrier 54 is rotationally seated by means of a peg 55 which serves as the bearing neck. In this embodiment the carrier 54 has two center contact blades 56 and 57 disposed in registry one above the other at a lateral arm 54*a* of the carrier 54. The cooperating stationary contact elements between which the center contact blades 56 and 57 move are correspondingly located in the relay at one side of the armature 21. In another embodiment, not shown in FIG. 8, the carrier 54 may be provided with another lateral arm mirror symmetric to the lateral arm 54*a* which may also have two contact blades in registry mounted therein so as to provide a total of four contact blades.

Figure 3:
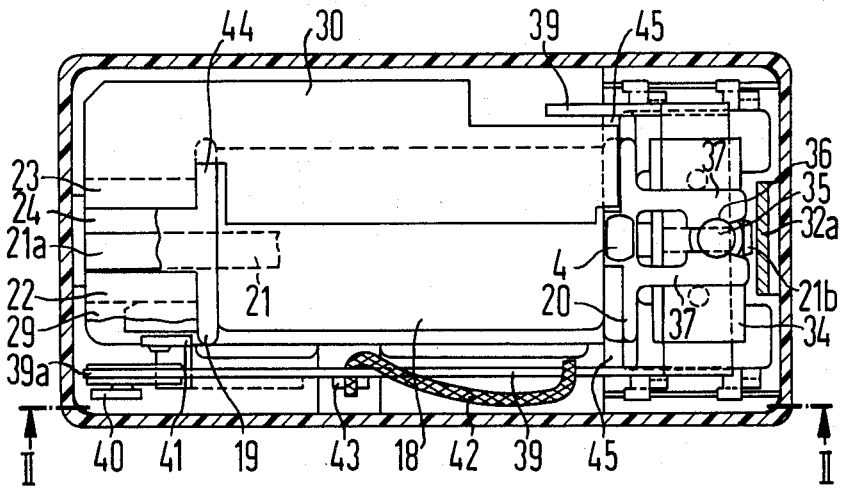
FIG. 3 is a plan sectional view of a relay constructed in accordance with the principles of the present invention taken along line III—III of FIG. 2, and through which the side sectional view of FIG. 2 is taken along line II—II.
Figure 9:
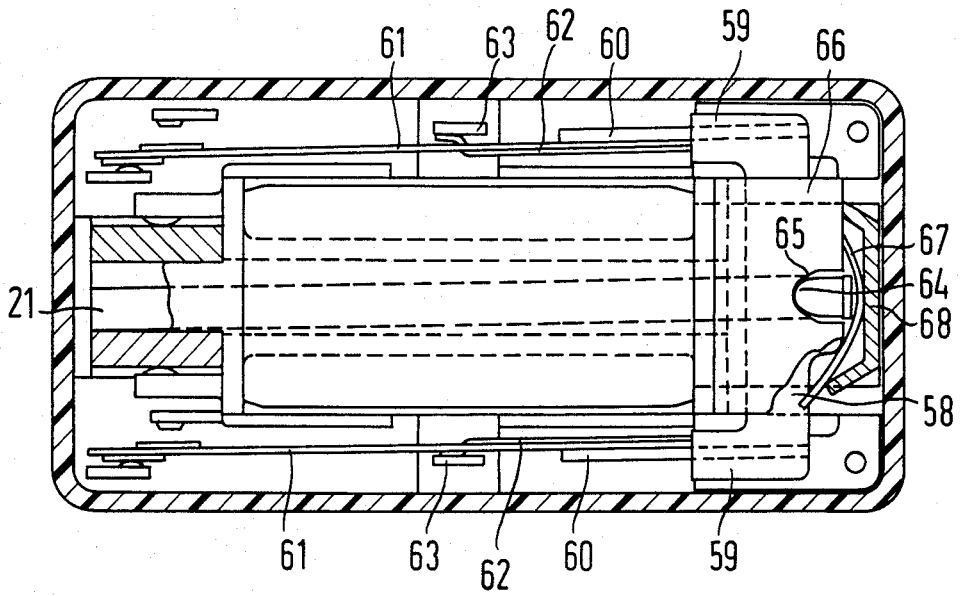
FIG. 9 is a plan sectional view of a relay constructed in accordance with the principles of the present invention showing a further embodiment for holding the carrier in place.

A further embodiment of the invention is shown in FIG. 9 which is a sectional view of a relay exhibiting this embodiment taken along the same sectional line as the first embodiment shown in FIG. 3. In the embodiment of FIG. 9, the armature 21 is mounted in a carrier 58 which has a pair of lateral arms 59 which are longer than the first embodiment shown in FIG. 3 and in which intermediate contact pieces 60 are embedded. Respective center contact blades 61 are welded to the intermediate contact pieces 60 and are also connected by means of connection springs 62 to connection pins 63 in the base body 11.

A further modification shown in the embodiment of FIG. 9 relates to the manner of the bearing mounting of the carrier 58 in the relay. In this embodiment, the carrier 58 has integrally formed bearing blades 64 which engage in corresponding bearing notches 65 of the coil body 66. The carrier 58 is urged into the bearing notchings 65 by means of a resilient foil 67. The foil 67 is held in place by an angled element 68 which may be a part of the flux plate 32 shown in FIG. 2.

Further modifications and combinations of the illustrated sample embodiments are also possible. For example, instead of the bearing blades 64, bearing necks may also be provided which press against corresponding recesses at the end face of the coil body and are held in the recesses by means of a leaf spring or a foil.

Figure 10:
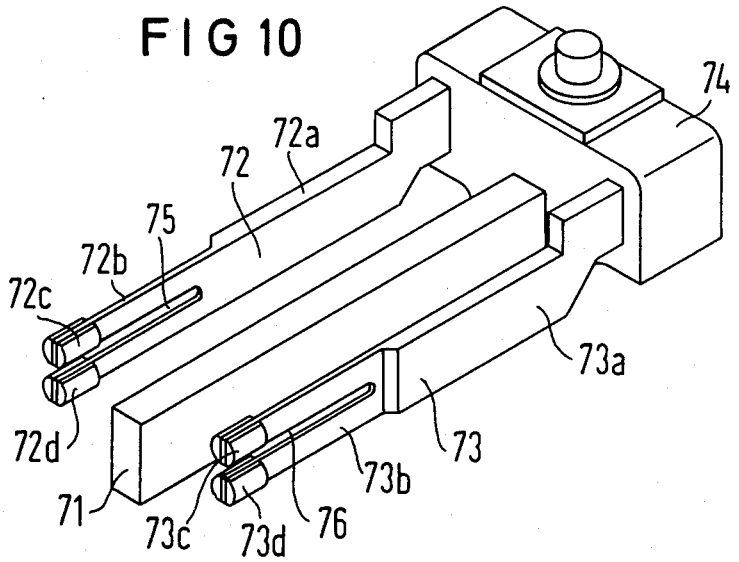
FIG. 10 is a perspective view of a third embodiment of a carrier into which the armature and two contact blades are mounted.

In a further embodiment shown in perspective view in FIG. 10, the armature 71 together with the two contact blades 72 and 73 are mounted in a carrier 74 by means of embedding or press fit so as to be parallel to each other as in the previous embodiments. The carrier 74 is constructed and seated as described in the above sample embodiments. In the embodiment of FIG. 10, however, each contact blade 72 exhibits a stepped cross-section. The blades 72 and 73 have respective first sections 72*a* and 73*a* with a thicker cross-section and respective thinner sections 72*b* and 73*b* at the free ends thereof. The first sections 72*a* and 73*a* are mounted in the carrier 74 and constitute at least half of the total length of the contact blades 72 and 73. The thinner section of the contact blades has a thickness which is less than or equal to one half of the thickness of the thicker sections, and in a preferred embodiment the thicker section is approximately three times as thick as the thinner section. The thinner sections 72*b* and 73*b* each have a longitudinal slot therein dividing the free ends of the contact blades 72 and 73 into forked pairs of contact springs having respective contact surfaces or pads 73*c* and 73*d* so as to form a double contact.

In an exemplary realization, the thickness of the first section 72*a* and 73*a* of the contact blades 72 and 73 may be approximately 0.5 mm and the thickness of the thinner sections 72*b* and 73*b* may be approximately 0.17 mm. As a result the thinner sections 72*b* and 73*b*, with the longitudinal slots 75 and 76, exhibit a high resiliency and therefore a high contact reliability and the slots 75 and 76 insure effective decoupling of the contacting end surfaces 72*c* and 72*d*, and 73*c* and 73*d*.

The thicker sections 72*a* and 73*a* produce the necessary spring constant for the overall contact blade and those unslotted sections are well-suited for adjustment of the contact blades. In particular, adjustment means which operate in a contact-free manner such as, for example, thermal adjustment by means of laser beams, can be employed. In so doing a very precise adjustment of the relay can be achieved, which in turn promotes contact reliability. The contact springs 72 and 73 are preferably cut from a metal strip having a stepped cross-section.

Although modifications and changes may be suggested by those skilled in the art it is the intention of the inventors to embody within the patent warranted hereon all changes and modifications as reasonably and properly come within the scope of their contribution to the art.

We claim as our invention:

1. An electromagnetic relay comprising:

a hollow coil body having a coil flange at each end thereof and a coil wound about said coil body between said flanges;

an insulating carrier and a means connecting said carrier and one of said flanges for pivotally seating said carrier at said one of said flanges;

a magnet system including at least one pole plate disposed at the other of said flanges, a magnetic flux source, and a bar-shaped armature disposed in said coil body for actuation by said flux source and having one end mounted in said carrier and a free end forming a working air gap with and being movable relative to said pole plate, and said armature extending over the length of said coil; and at least one contact blade mounted in said carrier spaced from said armature and extending over the length of said coil outside of said coil and having a free end movable with respect to at least one fixed contact, movement of said armature with respect to said pole plate being transmitted by pivoting said carrier for moving said contact blades.

2. The relay of claim 1 wherein said means for pivotally seating said carrier comprises a recess integrally formed on said one of said flanges by a pair of opposed bearing necks.

3. The relay of claim 2 wherein said means for pivotally seating said carrier further comprises a bearing neck received in said recess.

4. The relay of claim 1 wherein said means for pivotally seating said carrier has a bearing axis and wherein said contact blade is mounted in said carrier parallel to said armature outside said coil and offset by a selected spacing relative to said bearing axis.

5. The relay of claim 1 comprising at least two contact blades mounted in said carrier in registry in a shared plane parallel to said armature.

6. The relay of claim 1 comprising at least two contact blades disposed at opposite sides of said armature.

7. The relay of claim 6 wherein said carrier is a T-shaped block having a central portion and two opposed lateral arms, and wherein said armature is mounted in said central portion of said carrier and wherein at least one contact blade is mounted in each of said lateral arms.

8. The relay of claim 7 wherein said means for pivotally seating said carrier has a bearing axis and wherein said contact blades emerge from said carrier at right angles to said bearing axis and wherein each contact blade is bent and angled such that said contact blades extend parallel to said armature.

9. The relay of claim 1 wherein said contact blade is comprised of a first section disposed adjacent to said carrier having a first thickness and have a second section at an opposite end of said contact blade having a second thickness, said second thickness being less than or equal to one half of said first thickness.

10. The relay of claim 9 wherein said first section has a length which is approximately one half of the total length of said contact blade.

11. The relay of claim 9 wherein said second section of said contact blade has a longitudinal slot therein.

12. The relay of claim 9 wherein said thickness of said first section is approximately three times as large as the thickness of said second section.

13. The relay of claim 1 wherein said means for pivotally seating said carrier has a bearing axis and wherein said contact blade is mounted in said carrier in alignment with said armature in an extension of said bearing axis.

14. The relay of claim 1 wherein said means for pivotally seating said carrier comprises a pair of notches in said one coil flange and a bearing blade engaging said notches.

15. The relay of claim 14 wherein said means for pivotally seating said carrier further comprises a spring for urging said carrier against said one coil flange.

16. The relay of claim 15 wherein said spring consists of metal.

17. The relay of claim 15 wherein said spring consists of a resilient synthetic film.

18. The relay of claim 14 wherein said magnet system includes a permanent magnet and a flux plate disposed adjacents thereto and wherein said flux plate functions for holding said carrier in said recess.

19. The relay of claim 18 further comprising a spring disposed between said flux plate and said carrier further functioning for holding said carrier in said recess.

20. The relay of claim 1 wherein said carrier has a recess therein and wherein said armature is mounted in said carrier by plug-in insertion thereof in said recess.

* * * * *